US006488611B1

(12) United States Patent
Ambrosina et al.

(10) Patent No.: US 6,488,611 B1
(45) Date of Patent: Dec. 3, 2002

(54) EXERCISE RESISTANCE DEVICE

(75) Inventors: Jesse E. Ambrosina, Somerville; Gerhard Eduard-Franz Pawelka, Lexington; Harald Quintus-Bosz, Sudbury, all of MA (US); Tyler C. Marthaler, New York, NY (US)

(73) Assignee: Graber Products, Inc., Madison, WI (US)

( * ) Notice: Subject to any disclaimer, the term of this patent is extended or adjusted under 35 U.S.C. 154(b) by 0 days.

(21) Appl. No.: 09/390,426

(22) Filed: Sep. 7, 1999

(Under 37 CFR 1.47)

Related U.S. Application Data

(63) Continuation of application No. 08/920,402, filed on Aug. 29, 1997, now abandoned.

(51) Int. Cl.[7] ..... A63B 22/06

(52) U.S. Cl. ..... 482/63; 482/57; 482/58; 482/53; 482/112

(58) Field of Search ..... 482/57, 58, 63, 482/64, 61, 111, 112, 113, 53

(56) References Cited

U.S. PATENT DOCUMENTS

| | | | | |
|---|---|---|---|---|
| 3,373,992 A | | 3/1968 | Ludeman | |
| 3,494,616 A | | 2/1970 | Parsons | |
| 3,953,025 A | | 4/1976 | Mazman | |
| 4,171,802 A | * | 10/1979 | Stoecker | 272/67 |
| 4,441,705 A | | 4/1984 | Brown | |
| 4,645,199 A | | 2/1987 | Bloemendaal | |
| 4,674,742 A | | 6/1987 | Baetz | |
| 4,741,529 A | | 5/1988 | Bloemendaal | |
| 4,768,782 A | | 9/1988 | Blackburn | |
| 4,789,153 A | | 12/1988 | Brown | |
| 4,822,037 A | | 4/1989 | Makansi et al. | |
| 4,932,650 A | | 6/1990 | Bingham et al. | |
| 4,938,475 A | | 7/1990 | Sargeant et al. | |
| 5,026,047 A | | 7/1991 | Kosecoff | |
| 5,050,865 A | | 9/1991 | Augspurger et al. | |
| 5,083,772 A | | 1/1992 | Brown | |
| 5,195,936 A | | 3/1993 | Mao | |
| 5,221,613 A | | 6/1993 | Friesl | |
| 5,247,854 A | | 9/1993 | Wu | |
| RE34,479 E | | 12/1993 | Minoura | |
| 5,472,392 A | | 12/1995 | Haan et al. | |
| 5,542,507 A | * | 8/1996 | Warchocki et al. | 188/290 |
| 5,611,759 A | * | 3/1997 | Zeh et al. | 482/61 |

FOREIGN PATENT DOCUMENTS

| | | |
|---|---|---|
| WO | WO 98/13108 | 4/1998 |

* cited by examiner

*Primary Examiner*—Glenn E. Richman
*Assistant Examiner*—Tam Nguyen
(74) *Attorney, Agent, or Firm*—Boyle, Fredickson, Newholm, Stein & Gratz, S.C.

(57) ABSTRACT

A resistance applying device for use with an exercise apparatus includes a rotatable shaft, a rotatable impeller coupled to the rotatable shaft, a sealed housing surround the rotatable impeller, the sealed housing containing a fluid that provides resistance against the rotation of the impeller, and a barrier located between the rotatable impeller and the housing, the barrier and the rotatable impeller being configured to provide for relative movement between the barrier and the rotatable impeller.

15 Claims, 12 Drawing Sheets

EXERCISE RESISTANCE DEVICE

CROSS REFERENCES TO RELATED APPLICATIONS

This application is a continuation of U.S. application Ser. No. 08/920,402, filed Aug. 29, 1997 now abandoned, the disclosure of which is incorporated by reference herein.

BACKGROUND OF THE INVENTION

The present invention relates generally to a resistance device for use with exercise equipment, and more particularly to resistance units for bicycle trainers.

For many years, bicycle trainers have been used by bicycling enthusiasts to convert their bicycles for stationary riding. Rather than ride in cold or rainy weather, the cyclist can use the trainer to ride indoors and obtain an aerobic, cardiovascular workout. Bicycle trainers also obviate the need for purchasing a separate stationary bicycle for those persons who want to occasionally workout while, for example, reading or watching television. Regardless of the reasons for its use, a bicycle trainer should be easy to use and, to the extent possible, simulate bicycle riding on the open road.

To provide the user with a workout that simulates riding on the open road, a bicycle trainer should be designed with a resistance unit that provides increasing resistance to match the energy output of the rider. Presently, many conventional bicycle trainers do not simulate bicycle riding well because of the design limitations of their resistance units.

A typical bicycle trainer has a frame onto which the user mounts the bicycle. An example of a bicycle training system is described in U.S. Pat. No. 5,611,759. Typically, the rear wheel of the bicycle is contacted with a roller that is, in turn, connected to a resistance unit.

SUMMARY OF THE INVENTION

In general, in one aspect, the invention features a resistance applying device for use with an exercise apparatus including a rotatable shaft, a rotatable impeller coupled to the rotatable shaft, a sealed housing surrounding the rotatable impeller, the sealed housing containing a fluid that provides resistance against the rotation of the impeller, and a barrier located between the rotatable impeller and the housing, the barrier and the rotatable impeller being configured to provide for relative movement between the barrier and the rotatable impeller.

Embodiments of the invention may include one or more of the following features. The rotatable impeller can have at least one vane. The barrier can be located between a stationary impeller and the rotatable impeller. The stationary impeller can have at least one vane. The barrier can allow at least a portion of the vane of the stationary impeller to be exposed to the rotatable impeller. The barrier can have a slot through which the vane of the stationary impeller fits. The barrier can be substantially planar. The barrier can be a substantially circular plate. The invention can include a stationary impeller, the barrier being located between the stationary impeller and the rotatable impeller, the rotating and stationary impellers being substantially circular and planar, each with at least one vane on a surface, the surface of the rotating impeller having its respective vane being oriented to face the surface of the stationary impeller having its respective vane. An adjuster can adjust the relative position of the barrier and the rotatable impeller. The adjuster can be a movable resistance indicator accessible by an operator on the exterior of the housing.

In general, in another aspect, the invention features a resistance applying device for use with an exercise apparatus including a rotatable shaft, a rotatable impeller coupled to the rotatable shaft, the rotatable impeller having at least one vane, a fixed impeller facing opposite the rotatable impeller, the fixed impeller having at least one vane facing the rotatable impeller, a sealed housing surrounding the rotatable impeller and the fixed impeller, the sealed housing containing a fluid that provides resistance against the rotation of the impeller, and a barrier located between the rotatable impeller and the fixed impeller, the barrier allowing at least a portion of the vane of the fixed impeller to be exposed to the rotatable impeller.

Embodiments of the invention may include one or more of the following features. The relative position of the barrier and the rotatable impeller can be adjustable. Adjusting the relative position of the barrier and the rotatable impeller can change how much of the vane of the fixed impeller is exposed In general, in another aspect, the invention features a method for adjusting the resistance of a resistance applying device for use with an exercise apparatus, where the resistance applying device includes a rotatable shaft, a rotatable impeller coupled to the rotatable shaft, and a sealed housing surrounding the rotatable impeller, the sealed housing containing a fluid that provides resistance against the rotation of the impeller, including the steps of turning the rotatable impeller within the fluid within the sealed housing, and adjusting the volume of fluid adjacent to a moving surface of the rotatable impeller.

Embodiments of the invention may include one or more of the following features. The volume of fluid can be adjusted by changing the relative position of a plate and the rotatable impeller. The changing of the relative position can change the distance between the plate and the rotatable impeller. The distance can change along an axis substantially normally to the plate. The rotatable impeller can have at least one vane. A stationary impeller can be located between the rotatable impeller and the sealed housing, and the stationary impeller can have at least one vane. At least a portion of the vane of the stationary impeller can be exposed. A stationary impeller can be located between the plate and the sealed housing, wherein both the rotating and stationary impellers are substantially circular and planar, each with at least one vane on a surface, the surface of the rotating impeller having its respective vane being oriented to face the surface of the stationary impeller having its respective vane. An adjuster can be provided that adjusts the relative positions of the barrier and the rotatable impeller. The adjuster can be a movable resistance indicator accessible by an operator on the exterior of the housing.

Advantages of the invention may include one or more of the following. By varying the volume of resistance fluid adjacent to the rotatable impeller, or by varying the surface area of the vanes of a stationary impeller exposed to the fluid, the resistance imparted to the rotatable impeller can be varied. Users of the fluid resistance unit can thereby adjust the resistance to exercise at varying levels of difficulty. Users can vary the resistance of a fluid resistance unit either continuously or in discrete steps. The adjustment of resistance can be accomplished easily by changing an external lever. A fixed fluid resistance unit can have the amount of its resistance preset at a factory, by simply inserting one of a number of differently spaced barrier plates. The fluid resistance unit can offer progressive resistance to progressively challenge the user. The fluid resistance unit is modular and quiet, and relatively inexpensive to produce.

These and other features and advantages of the present invention will become more apparent from the following description, drawings, and claims.

DESCRIPTION OF THE PREFERRED EMBODIMENTS

Figure 1:
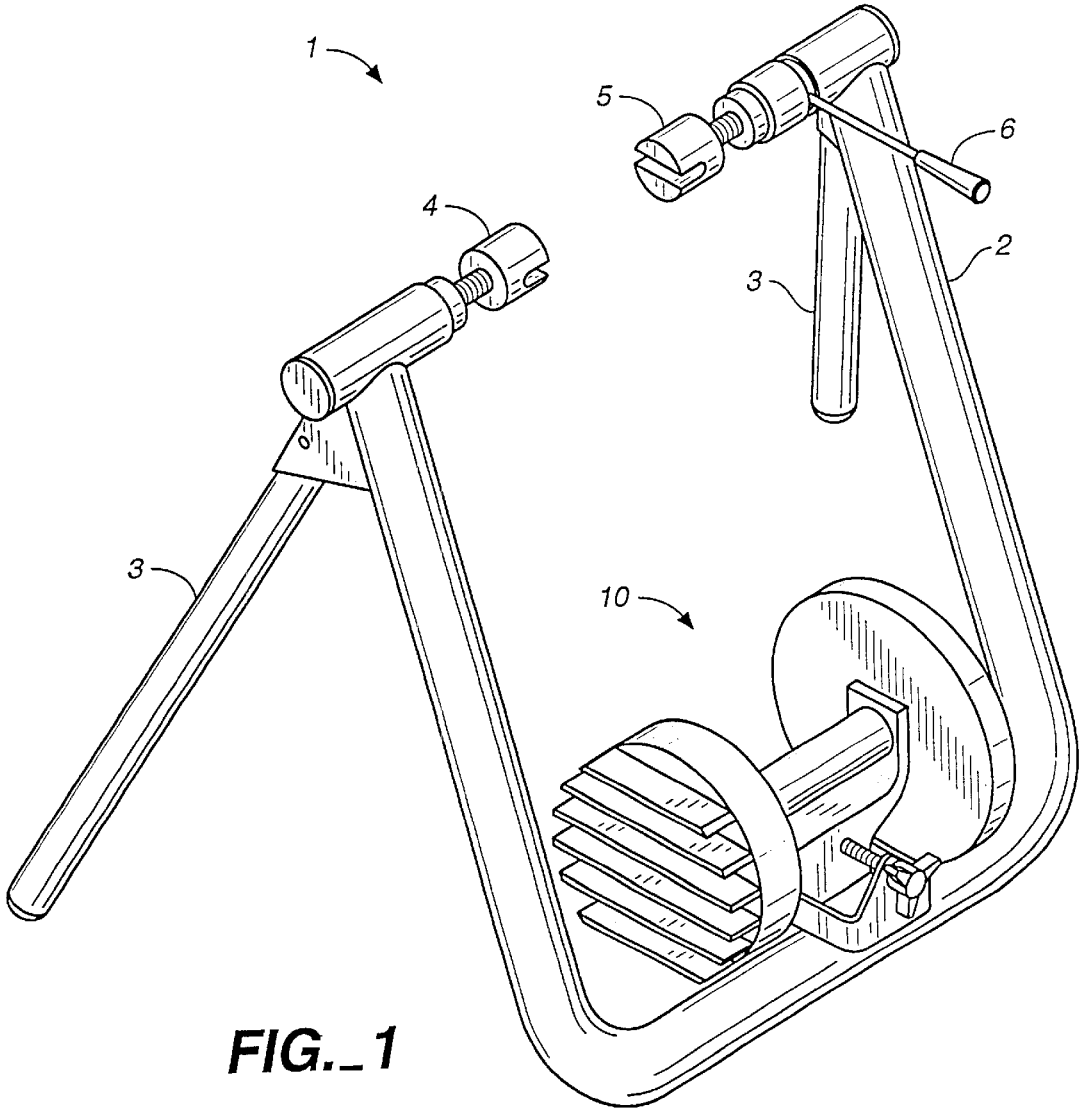
FIG. 1 is a perspective drawing showing a bicycle trainer with a fluid resistance unit.

In FIG. 1, a bicycle trainer 1 is shown ready for use, and has a U-shaped frame 2 and retractable legs 3 that provide a stable base. Legs 3 fold in towards frame 2 to allow bicycle trainer 1 to be easily stored. The frame of the bicycle trainer can be made in a variety of configurations, provided the bicycle and rider are held in a stable, upright position.

Figure 2:
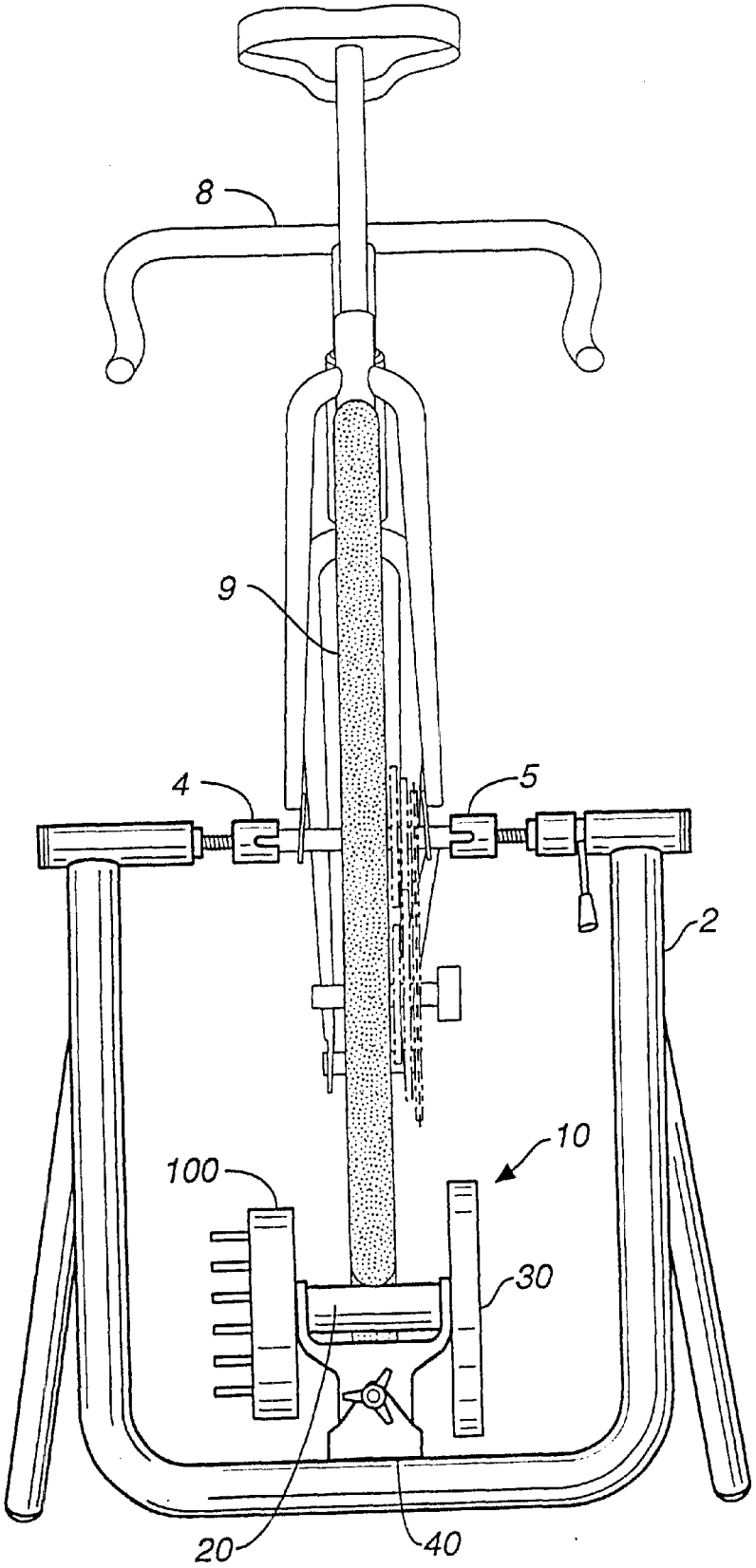
FIG. 2 is a rear-view drawing of the bicycle trainer of FIG. 1 with a bicycle positioned for use by a rider.
Figure 3:
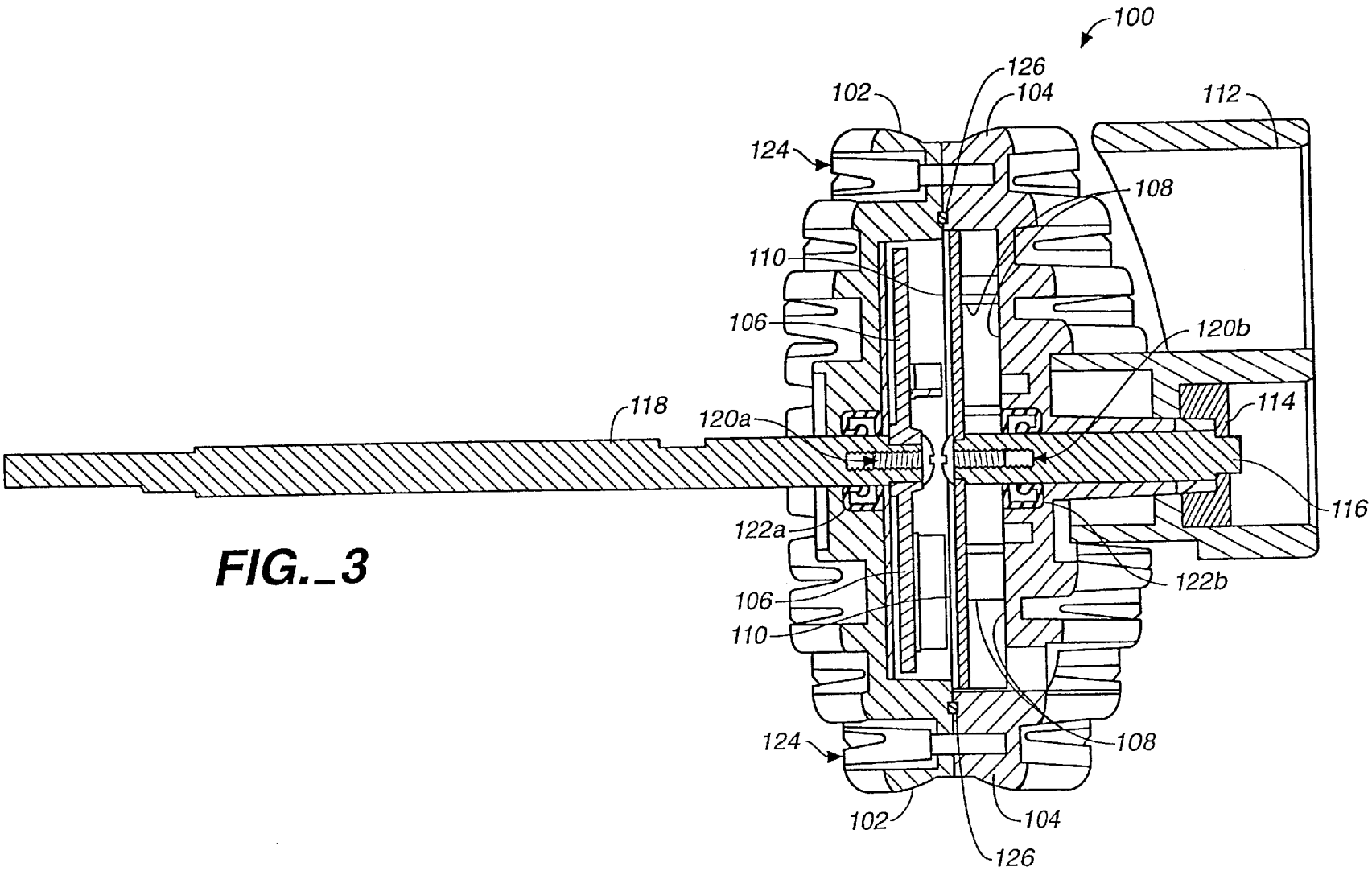
FIG. 3 is a cross-section of a fluid resistance unit.
Figure 4A:
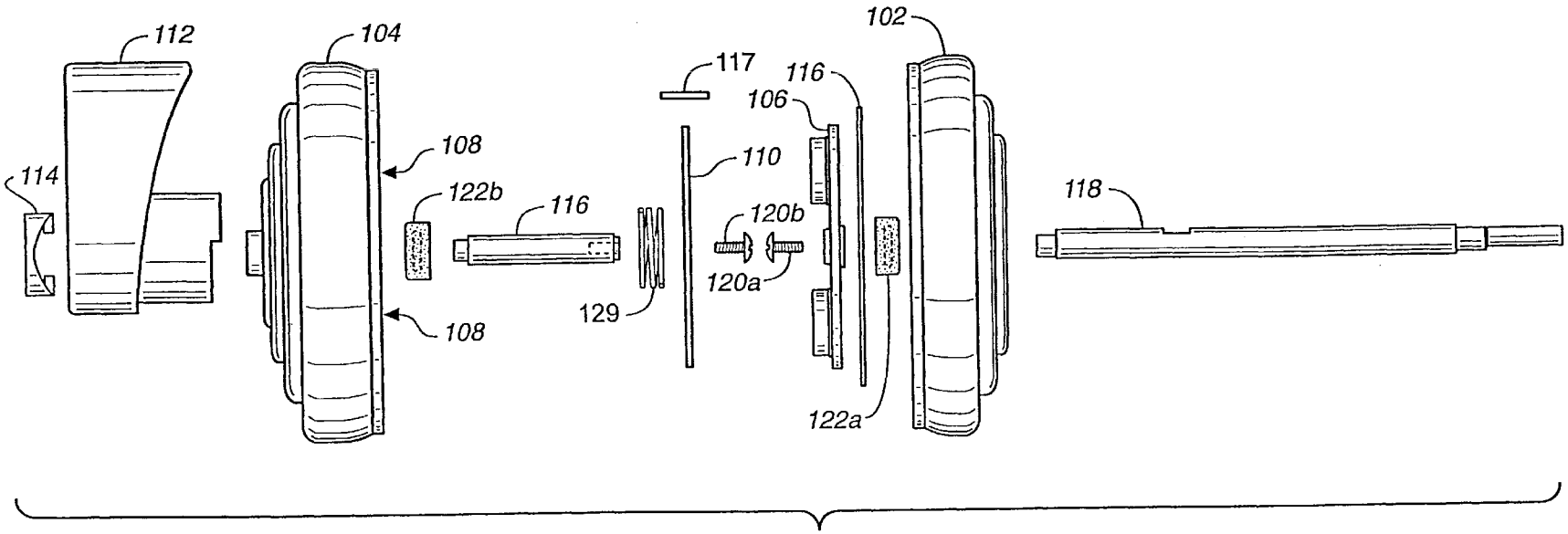
FIGS. 4*a* through 4*c* are exploded views of the fluid resistance unit of FIG. 3.
Figure 4B:
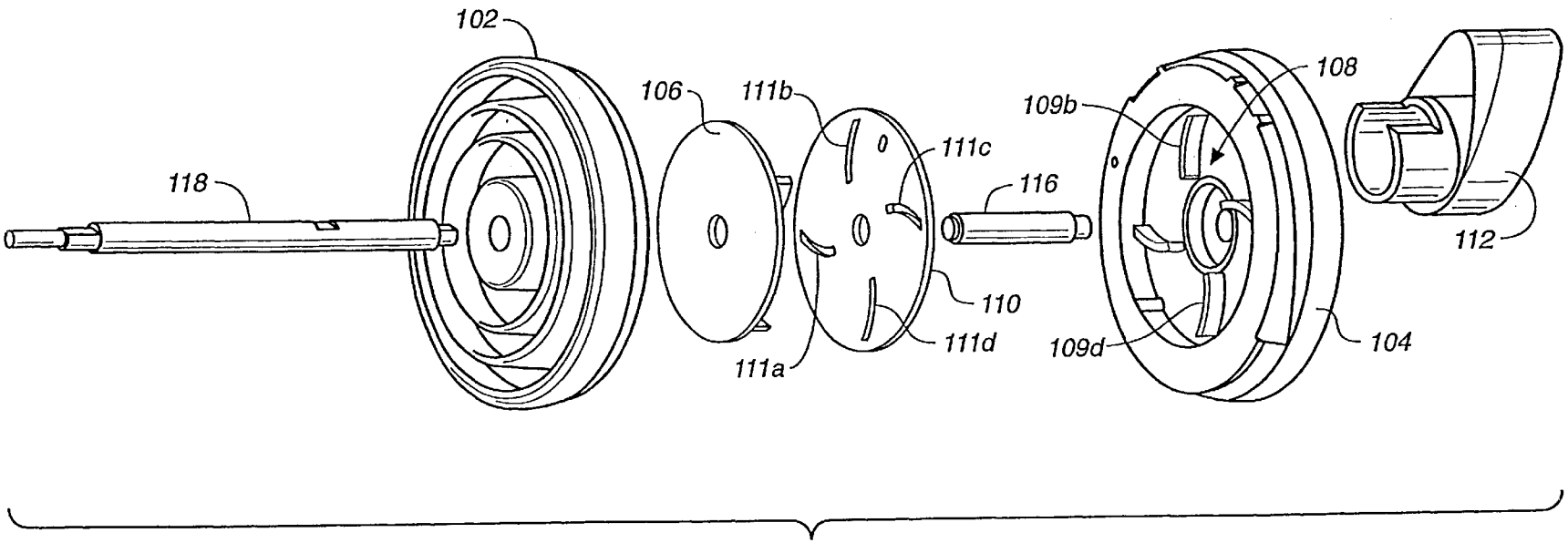
Figure 4C:
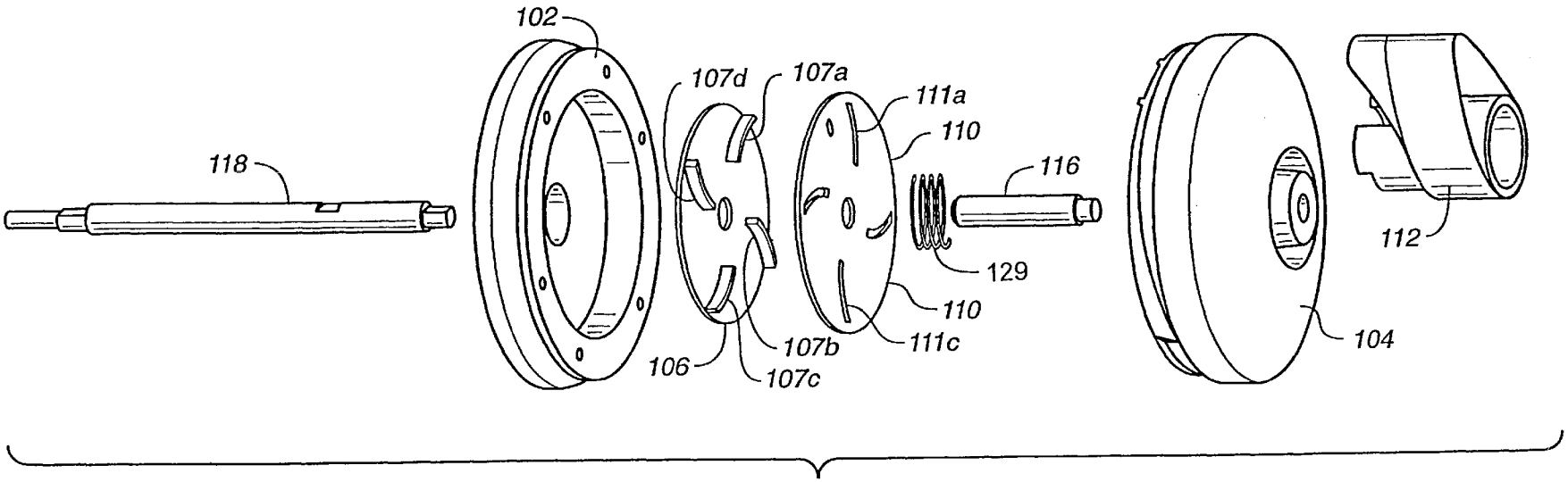

As shown in FIG. 2, rear wheel 9 of bicycle 8 is held in place by clamps 4 and 5. The position of clamp 4 is fixed and clamp 5 is movable by means of handle 6, and together they allow bicycle 8 to be positioned and securely held. Resistance unit 10 is shown having a rotatable fluid shaft 118, which via optional larger diameter roller 20 is in frictional contact with rear wheel 9, a fluid resistance unit 100 and a fly wheel 30. Resistance unit 10 is designed to be a movable modular unit, which is attached to frame 2 by yoke 40. The modular design allows resistance unit 10 to be separately manufactured and later assembled with the other components of bicycle trainer 1.

Referring to FIGS. 3, and 4*a* through 4*c,* fluid resistance unit 100 includes s a first cavity shell 102 and a second cavity shell 104, fastened together with seals to form a fluid-tight chamber. Impeller 106 rotates within the cavity formed by first and second cavity shells 102 and 104, by virtue of its attachment to fluid shaft 118.

Fly-wheel 30 can be connected to the opposite end of-fluid shaft 118. A larger diameter roller 20 (as shown in FIG. 2) can slip over and attach to fluid shaft 118 to increase the circumference of the frictional surface that contacts rear wheel 9.

Static impeller 108 (which can be essentially a duplicate of the face of impeller 106) is placed opposite impeller 106, and can be formed integrally with the inside surface of second cavity shell 104. Both impellers 106 and 108 are oriented in a generally upright position with respect to first and second cavity shells 102 and 104.

Barrier plate 110, having perforations 111 shaped to accept a number of vanes 109 of static impeller 108, fits over static impeller 108. Plate 110 is movable toward and away from impeller 106 by the action of lever 112 which moves cam disk 114 that in turn moves plate shaft 116 (attached to plate 110) forward and backward along the axis of resistance unit 100. The movement of plate 110 relative to impeller 106 exposes more or less of the surface area of vanes 109 of static impeller 108, and also changes the volume of resistance fluid adjacent the surface area of impeller 106. Both of these changes, caused by the movement of plate 110, alter the-resistance presented to impeller 106 moving in the fluid. An indication on the exterior surface of second cavity shell 104 can indicate, based upon the location of lever 112, the current relative amount of resistance.

As shown, impellers 106 and 108 are generally flat circular plates having protruding vanes extending from one side. It should be understood that the impellers can have various configurations without affecting the operation of the resistance unit, including designs such as propellers, paddle wheels, and screws.

Spring 129 seats between plate 110 and the inside surface of second cavity shell 104, providing a force for returning plate 110 to its initial position, roughly halfway between the movable impeller 106 and static impeller 108. Screws 120*a* and 120*b* attach impeller 106 to fluid shaft 118 and plate 110 to plate shaft 116, respectively. Seals 122*a* and 122*b* seat around fluid shaft 118 and plate shaft 116, helping to reduce, if not eliminate, fluid leakage. Also, first and second cavity shells 102 and 104 are held in place by screws 124, and are sealed by o-ring 126.

A variety of resistance fluids can be used in the fluid resistance unit 100. Although not an operational requirement, it is preferred that the resistance fluid be non-toxic. Generally, the resistance fluid should have a viscosity in the range of 1 to 500 cs. Larger impellers can be required if the viscosity of the fluid is small, to achieve a similar imparted resistance. The resistance fluids that can be used include silicone compounds, vegetable oils, mineral oils, water-based lubricants, etc.

In a preferred embodiment, the fluid used in the resistance unit is a silicone compound, specifically, a pure silicon fluid with a 50 cs viscosity, because of its relatively high boiling point of about 400° F.

If water is used as the resistance fluid, a small amount of water soluble oil can be added to the fluid to provide lubricity and as an anti-corrosive agent. It is important that the chosen resistance fluid have a low coefficient of compression.

The amount of resistance fluid used to fill the housing should be sufficient to cover the vanes of the impeller. The housing can be left partially unfilled leaving a small volume of air for thermal expansion of the fluid when the trainer is used, otherwise the seal to the housing may be damaged. It is possible to replace the fluid used in the impeller unit to vary the resistance that can be obtained.

Figure 5B:
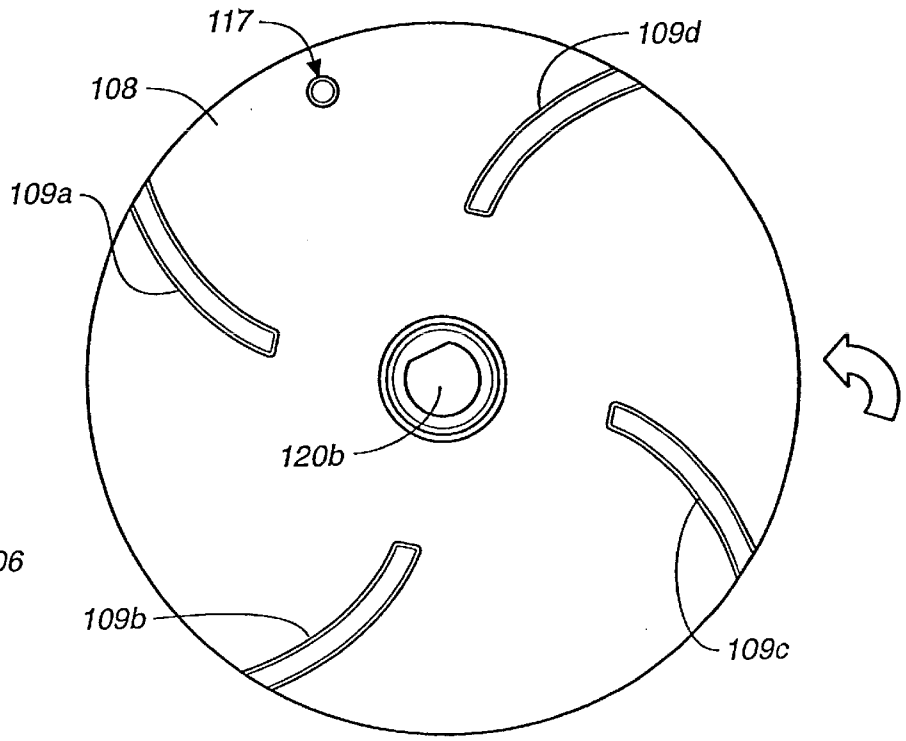
FIGS. 5*a* and 5*b* are respective axial views of a rotatable impeller and static impeller for the fluid resistance unit of FIG. 3.
Figure 5A:
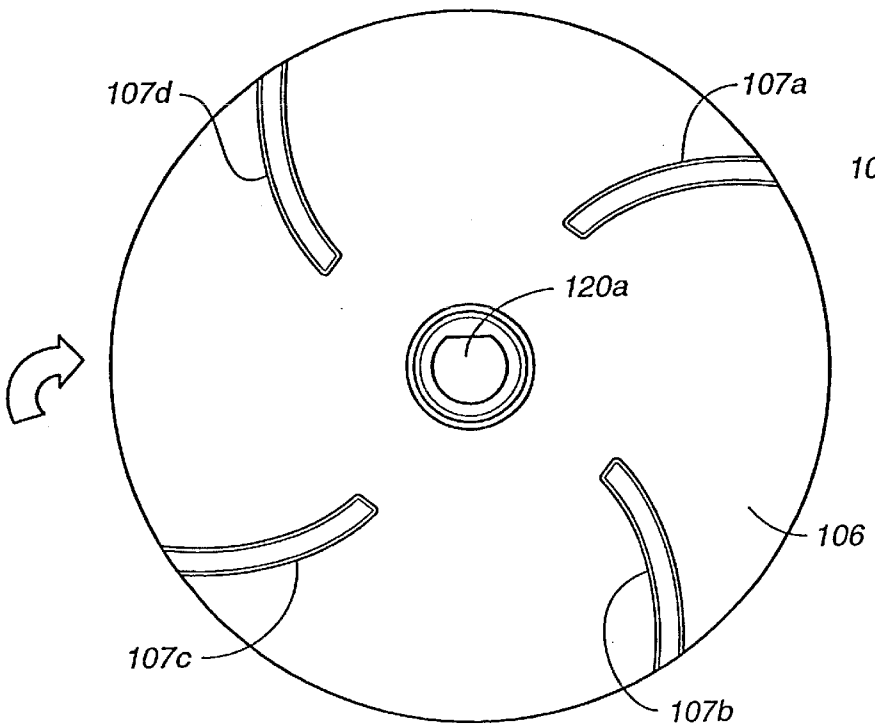
Figure 7A:
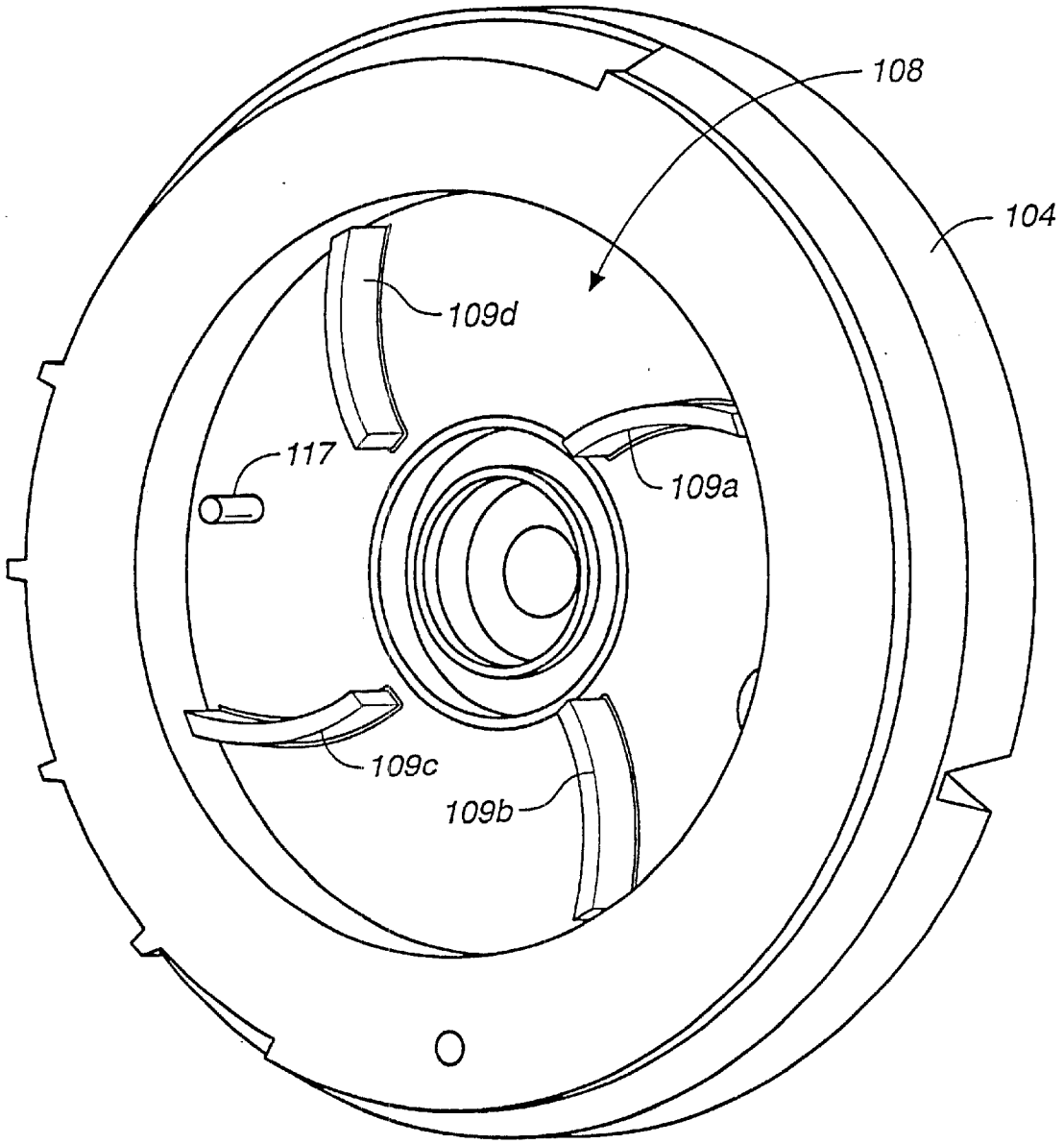
FIGS. 7*a* and 7*b* are perspective views on an inner surface of one shell of a housing having an internal fixed impeller.
Figure 7B:
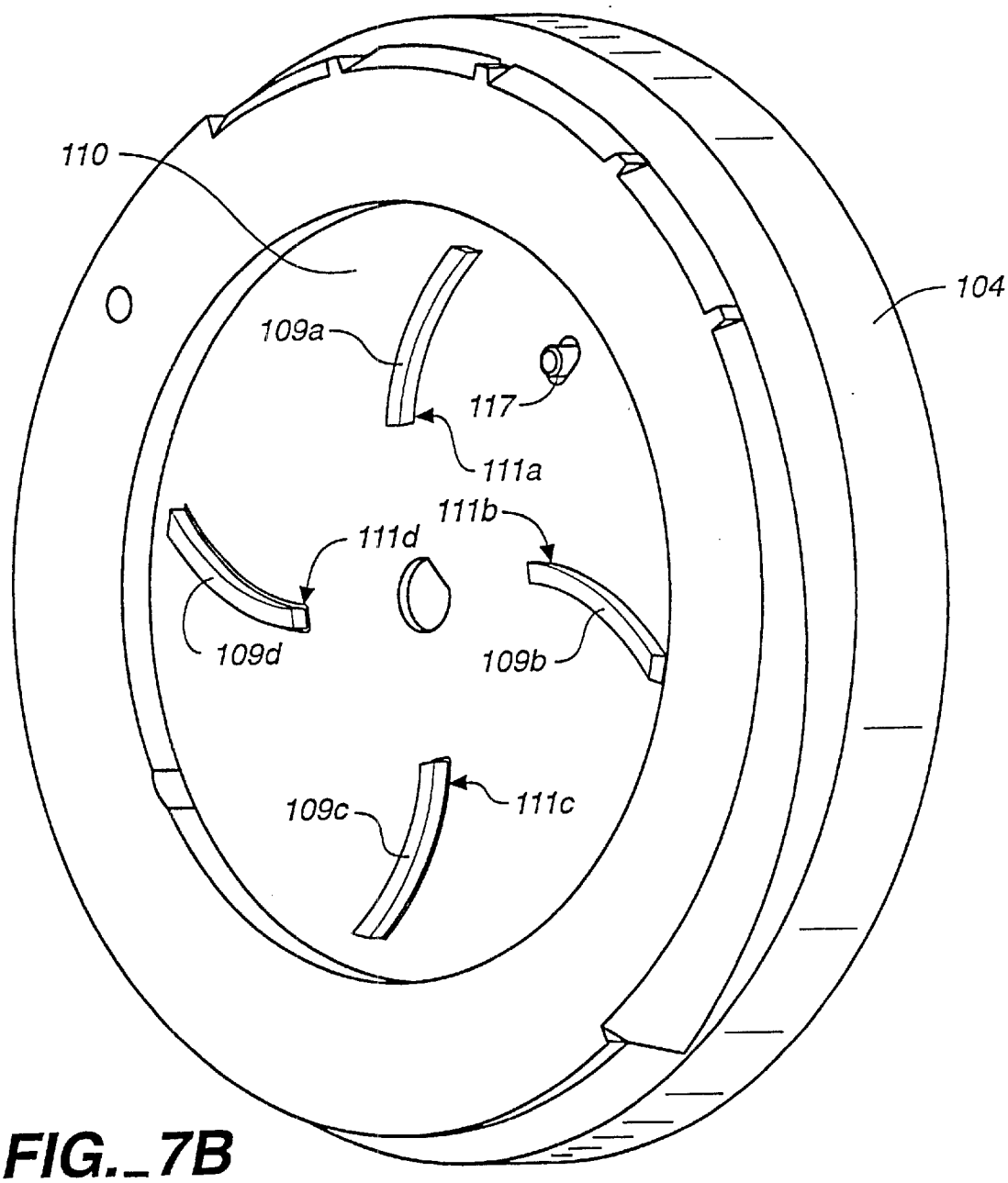

Referring to FIGS. 5*a,* 5*b,* 6, and perspective FIGS. 7*a* and 7*b,* impeller 106 has a number of vanes 107*a* through 107*d,* while static impeller 108 also has a number of vanes 109*a* through 109*d.* Impeller 106 and static impeller 108 can each have any number of vanes (including none), depending on the size of the impeller and impeller housing, and their respective number of vanes can be the same or different, and can be the same shape or different. In the present embodiment, four vanes are used, each spaced apart equally at approximately 90° around the circumference of each impeller 106 and 108. The vanes have inner concave surfaces in the direction of rotation. The curved surfaces move the fluid by a scooping action that provides resistance during rotation.

The vanes can be made in a variety of shapes to provide the necessary resistance in the fluid. The lead surface of the vanes can be less streamlined to provide more resistance or more streamlined to provide less resistance as the impeller rotates in the fluid. It is within the scope of the invention to use vanes that have lead surfaces that are flat, trapezoidal, curved, etc. It is preferred that the lead surface of the vanes be offset at an angle from the radius of the impeller. The impellers are preferably made of metal using conventional casting methods. Other materials can be used including refractory ceramics, plastics, etc.

By exposing more or less of the surface area of vanes 109 of static impeller 108, and by also reducing the volume between plate 110 and impeller 106, by moving plate 110, fluid resistance unit 100 can vary the amount of drag experienced by impeller 106 rotating within its fluid.

Figure 6:
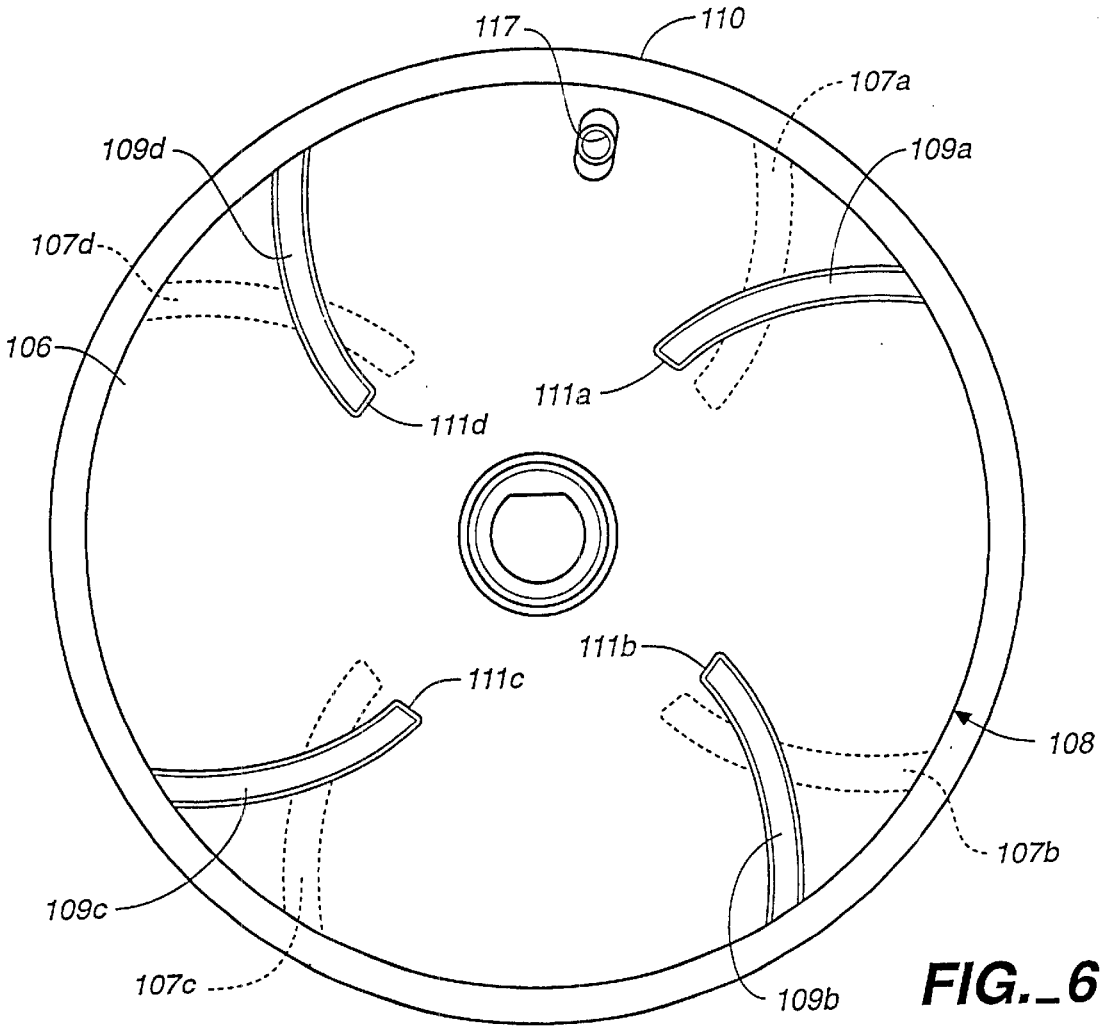
FIG. 6 is a superimposed phantom view of the rotatable impeller and static impeller of FIGS. 5*a* and 5*b*.

Referring to FIG. 6, a superimposition of impeller 106 and static impeller 108 (shown in phantom looking through impeller 106) shows that vanes 107 and 109 are curved in opposite directions, increasing the amount of drag experienced by impeller 106 as it rotates. Vanes 107 and 109 do not necessarily need to be cupped or in opposite directions (e.g., vanes 107 and 109 can be flat, or cupped away from each other). Vanes 109 protrude through respective slots 11 in plate 110. Alignment pin 117 aligns plate 110 with static impeller 108 as plate 110 moves up and down vanes 109.

Figure 8:
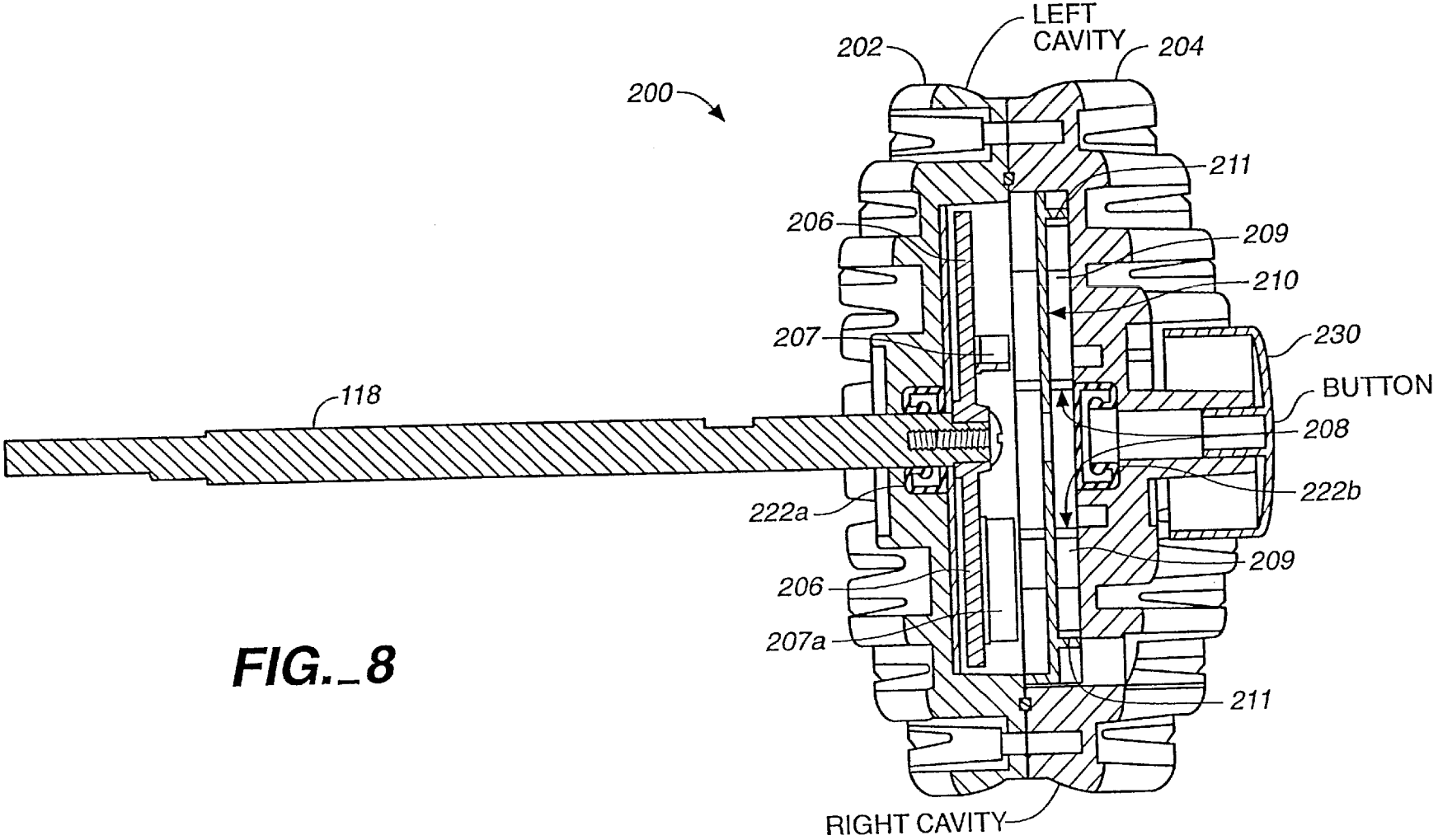
FIG. 8 is a cross-section of a fluid resistance unit.
Figure 9:
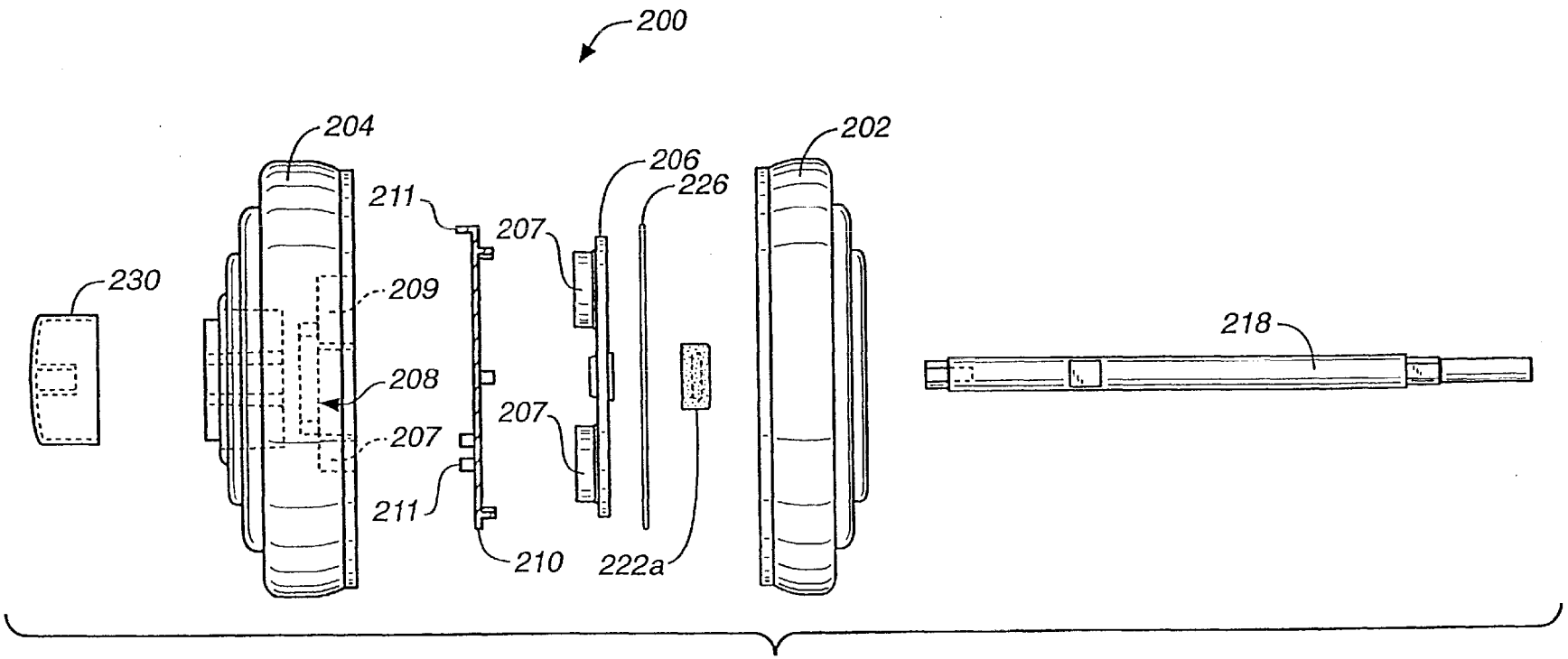
FIG. 9 is an exploded view of the fluid resistance unit of FIG. 8.

Referring to FIGS. 8 and 9, another resistance unit 200 includes first and second cavity shells 202 and 204, which contain a rotatable impeller 206, a static impeller 208 (which can be, as above, fabricated integral to the inside of second cavity shell 204), and a fixed plate 210 which, as with plate 110 above, has perforations for fitting over vanes 209 of static impeller 208. In fluid resistance unit 200, however, fixed plate 210 is set at a fixed distance along the vanes of static impeller 208 (that is, at a fixed distance along the axis of resistance unit 200) by standoffs 211, so that a certain amount of surface of vanes 209 of static impeller 208 can be set exposed to the movement of the fluid flowing around vanes 209 and vanes 207 of impeller 206. Essentially resistance unit 200 operates in similar fashion to resistance unit 100, but with plate 210 fixed at a certain point along the resistance unit axis.

The two types of units 100 and 200 can be manufactured with a number of similar parts, and a button 230 can be used in fixed fluid resistance unit 200 to cover the hole in the housing that, in adjustable fluid resistance unit 100, provides the access for lever 112, cam disk 114, and plate shaft 116 to otherwise cooperate to change the distance of plate 110. At the factory, a fixed plate 210 having a particular length of standoffs 211 can be selected from a number of fixed plates 210 having different length standoffs 211, and can be inserted to provide a selected amount of resistance to impeller 206. This allows for easily setting the manufactured fluid resistance unit 200 to any of a number of resistances, as desired. Resistance unit 200 can be configured to allow end users to exchange one fixed plate 210 for another, to change the resistance of unit 200.

Other embodiments of the invention are within the scope of the claims. For example, the movable plate can be placed over the vanes of the rotating impeller, variably exposing its vane surface area, to change the frictional forces imparted to the impeller, and such a movable plate and impeller arrangement can be used with or without a corresponding static impeller. The rotating or stationary impellers can move instead of the plate, thereby changing their relative positions. Both sets of vanes of an impeller and static impeller can be covered with either movable or fixed disks to expose selected amounts of vane surface area. The vanes of either the impeller or the static impeller can be adjustable, such that the angles at which the vanes "attack" the surrounding fluid can be changed, changing the imparted resistance. The impeller can be just a disk without vanes, and its resistance can be adjusted by exposing more or less of its surface area to its surrounding fluid. The shaft attached to the moving impeller can pass through the static impeller.

We claim:

1. A resistance applying device for use with an exercise apparatus comprising:

a rotatable shaft;

a rotatable impeller coupled to the rotatable shaft, the rotatable impeller having at least one vane;

a fixed impeller facing opposite the rotatable impeller, the fixed impeller having at least one vane facing the rotatable impeller;

a sealed housing surrounding the rotatable impeller and the fixed impeller; the sealed housing containing a fluid that provides resistance against the rotation of the impeller; and a barrier located between the rotatable impeller and the fixed impeller, the barrier allowing at least a portion of the vane of the fixed impeller to be exposed to the rotatable impeller.

2. The device of claim 1 wherein the position of the barrier is adjustable relative to the rotatable impeller.

3. The device of claim 2 wherein adjusting the position of the barrier relative to the rotatable impeller changes how much of the vane of the fixed impeller is exposed.

4. A resistance applying device for use with an exercise apparatus comprising:

a rotatable shaft;

a rotatable impeller coupled to the rotatable shaft;

a sealed housing surrounding the rotatable impeller, the sealed housing containing a fluid that provides resistance against the rotation of the impeller;

a stationary impeller having at least one vane; and a barrier located between the rotatable impeller and the stationary impeller, the barrier and the rotatable impeller being configured to provide for movement of the barrier relative to the rotatable impeller, wherein the barrier allows at least a portion of the vane of the stationary impeller to be exposed to the rotatable impeller.

5. The device of claim 4 wherein the rotatable impeller has at least one vane.

6. The device of claim 4 wherein the barrier is substantially planar.

7. The device of claim 6 wherein the barrier is a substantially circular plate.

8. The device of claim 4 further comprising an adjuster that adjusts the position of the barrier relative to the rotatable impeller.

9. A resistance applying device for use with an exercise apparatus comprising:

a rotatable shaft;

a rotatable impeller coupled to the rotatable shaft;

a sealed housing surrounding the rotatable impeller, the sealed housing containing a fluid that provides resistance against the rotation of the impeller;

a stationary impeller having at least one vane;

a barrier located between the rotatable impeller and the stationary impeller, wherein the barrier has at least one slot through which the vane of the stationary impeller fits; and a position adjustment arrangement for adjusting the position of the barrier relative to the rotatable impeller.

10. The device of claim 9 wherein the volume of fluid is adjusted by changing the position of the barrier relative to the rotatable impeller.

11. The device of claim 9 wherein the rotatable impeller has at least one vane.

12. The device of claim 11 further comprising an adjuster that adjusts the position of the barrier relative to the rotatable impeller.

13. A method for adjusting the resistance of a resistance applying device for use with an exercise apparatus, where the resistance applying device includes a rotatable shaft, a rotatable impeller coupled to the rotatable shaft, and a sealed housing surrounding the rotatable impeller, the sealed housing containing a fluid that provides resistance against the rotation of the impeller, and a stationary impeller located between the rotatable impeller and the sealed housing, the stationary impeller having at least one vane; comprising the steps of:

exposing at least a portion of the vane of the stationary impeller through a barrier; turning the rotatable impeller within the fluid within the sealed housing; and adjusting the volume of fluid adjacent to a moving surface of the rotatable impeller.

14. A resistance applying device for use with an exercise apparatus comprising:

a rotatable shaft;

a rotatable impeller coupled to the rotatable shaft;

a sealed housing surrounding the rotatable impeller, the sealed housing containing a fluid that provides resistance against the rotation of the impeller;

a stationary impeller having at least one vane; and a barrier located between the rotatable impeller and the stationary impeller, the barrier and the stationary impeller being configured to provide for relative movement of the barrier relative to the stationary impeller, wherein the barrier allows at least a portion of the vane of the stationary impeller to be exposed to the rotatable impeller.

15. The method of claim 13, wherein the step of adjusting the volume of fluid adjacent to a moving surface of the rotatable impeller is carried out by adjusting the position of the barrier to adjust the exposed portion of the vane of the stationary impeller.

* * * * *